US006550524B2

(12) United States Patent
Mochizuki

(10) Patent No.: US 6,550,524 B2
(45) Date of Patent: Apr. 22, 2003

(54) SHUTTER

(75) Inventor: Masanori Mochizuki, Yao (JP)

(73) Assignee: Isel Co., Ltd., Osaka-fu (JP)

( * ) Notice: Subject to any disclaimer, the term of this patent is extended or adjusted under 35 U.S.C. 154(b) by 0 days.

(21) Appl. No.: 09/986,294

(22) Filed: Nov. 8, 2001

(65) Prior Publication Data

US 2002/0053411 A1 May 9, 2002

(30) Foreign Application Priority Data

Nov. 9, 2000 (JP) ..... 2000-341973

(51) Int. Cl.[7] ..... E05D 15/26
(52) U.S. Cl. ..... 160/201
(58) Field of Search ..... 160/201, 207, 160/133, 119; 16/94 R, 95 R, 96 R

(56) References Cited

U.S. PATENT DOCUMENTS 1,791,527 A * 2/1931 Hoffman ..... 16/94 R
2,257,513 A * 9/1941 Pilcher ..... 160/201
2,275,730 A * 3/1942 Casse ..... 160/119
2,534,641 A * 12/1950 Veigel ..... 160/94 R
2,686,926 A * 8/1954 Schacht et al. ..... 16/94 R
2,991,496 A * 7/1961 Wolf et al. ..... 16/94 R
3,056,451 A * 10/1962 Federline et al. ..... 160/201

* cited by examiner

*Primary Examiner*—David M. Purol
(74) *Attorney, Agent, or Firm*—Fitch, Even, Tabin & Flannery

(57) ABSTRACT

A shutter has a shutter panel and a pair of guide rails that hold both end portions of the shutter panel slidably. The guide rails have curved portions. Each of the guide rails includes straight members having parallel tie plates and an interval plate connecting central portions of the tie plates resulting in an H-shaped section. Each of the guide rails includes corner members having curved plates succeeding to the tie plates. Both end portions of the shutter panel are inserted slidably between inner half portions of the tie plates partitioned by the interval plates, and outer half portions of the tie plates are mounted to a fixing portion to thereby enable smooth sliding movement of the shutter panel within the guide rails.

10 Claims, 6 Drawing Sheets

SHUTTER

BACKGROUND OF THE INVENTION

1. Field of the Invention

The present invention relates to a shutter for opening and closing an aperture or an entrance of a housing. More particularly, it relates to guide rails for holding both end portions of a shutter panel slidably.

2. Disclosure of the Prior Art

A shutter of this kind is generally comprised of a shutter panel in which a plurality of slats is aligned in a mutually bendable manner and guide rails for holding both end portions thereof in a freely sliding manner.

The guide rails are usually U-shaped members having a U-shaped groove for accommodating the both end portions of the shutter panel therein, and in case an aperture formed at a front surface and an upper surface of the housing successively is to be closed by the shutter panel, the linear U-shaped members are partially bent in order to form guide rails that are curved in extending from the front surface to the upper surface of the aperture and are fixed to a fixing portions of the aperture by screwing.

In this prior art, since fixing of the guide rails to the fixing portions is achieved by screwing from inner sides of the groove of the U-shaped members, head portions of mounting screws may be exposed to the inner sides of the groove and is apt to be a hindrance in performing smooth sliding of both end portions of the shutter panel.

At a curved portion that is formed by bending the members, intervals of the U-shaped sections, that is, widths of groove for holding both end portions of the shutter panel, will become narrow and result in a larger resistance at the time of sliding, and it will accordingly be necessary to preliminarily set the widths of the groove to be large in view of portions that become narrow through bending.

SUMMARY OF THE INVENTION

It is an object of the present invention to enable smooth sliding of both end portions of a shutter panel within guide rails of a shutter in which the shutter panel is composed of plural slats connected mutually in a freely bending condition and a pair of guide rails including curved portions hold the both end portions of the shutter panel slidably.

The shutter according to the present invention, which has been made for achieving the above objects, is characterized in that each of the guide rails includes straight members comprised of parallel tie plates and interval plate for connecting central portions of the tie plates mutually for having a H-shaped section, and corner members comprising curved plates respectively succeeding to the tie plates of the straight members, and the both end portions of the shutter panel are inserted between inner half portions of the tie plates partitioned by the interval plate slidably, and outer half portions of the tie plates are mounted to a fixing portions.

Each of the tie plates is partitioned into an inner half portion and an outer half portion by the interval plate.

Since the guide rails are fixed to the fixing portions via the outer half portions of the tie plates, no fixing members such as mounting screws will be exposed to the inner half portions for holding both end potions of the shutter panel in a freely sliding manner. Moreover, since curved portions of the guide rails are comprised of corner members that have been preliminarily shaped into curved conditions, intervals between respective curved plates will not be deformed as it is the case with an arrangement in which straight members are bent to form the curved portions. So the intervals may be set to appropriate values. Thus, the intervals between the tie plates in the inner half portions receiving the both end portions of the shutter panel slidably may be made uniform all over the guide rails.

The corner members may be shaped to be of H-shaped sections similar to the straight members or may alternatively be comprised of a pair of curved plates only.

Because of the above arrangement, the present invention exhibits the following unique effects.

The intervals of the inner half portions of the guide rails for holding both end portions of the shutter panel in a freely sliding manner may be made uniform all over the guide rails, and fixing members such as heads of mounting screws can be prevented from being exposed to inside of the inner half portions, whereby the shutter panel may slide smoothly.

Other objects, features, aspects and advantages of the invention will become more apparent from the following detailed description of embodiments with reference to the accompanying drawings and appended claims.

DETAILED DESCRIPTION OF THE INVENTION

Embodiments of the present invention will now be explained in accordance with the drawings.

Figure 1:
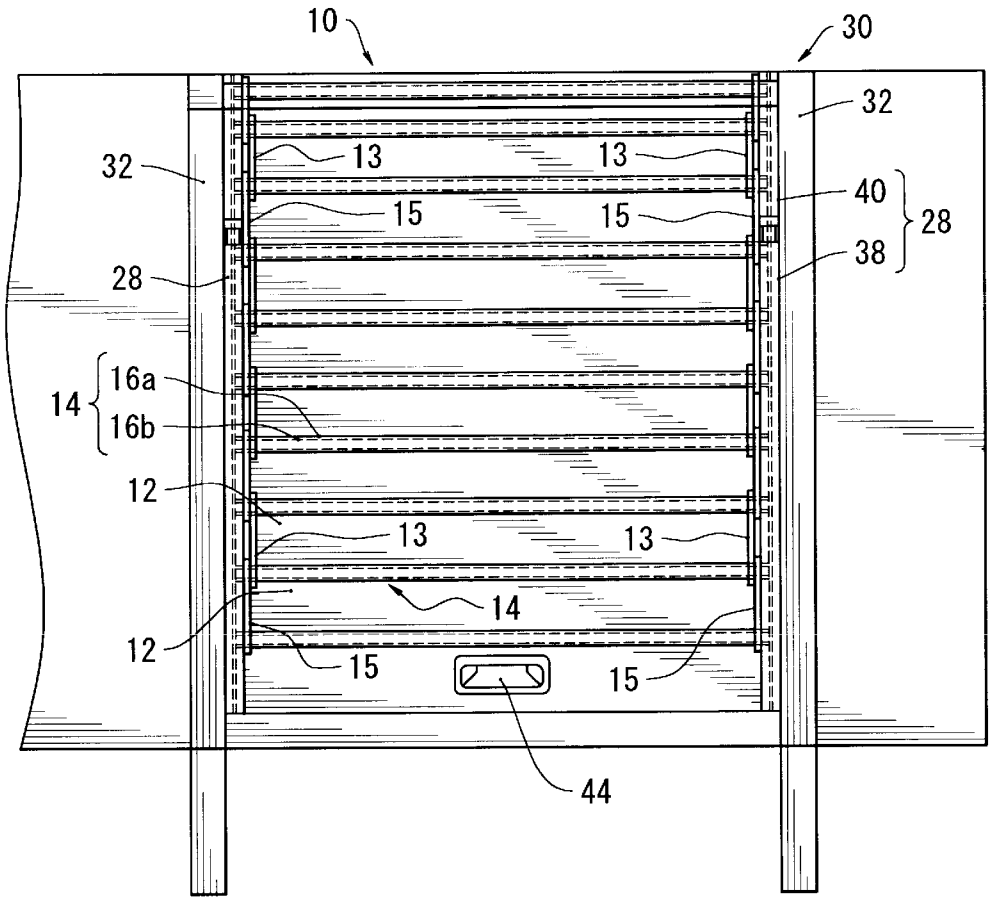
FIG. 1 is a view showing an external appearance of one example for using the shutter.
Figure 2:
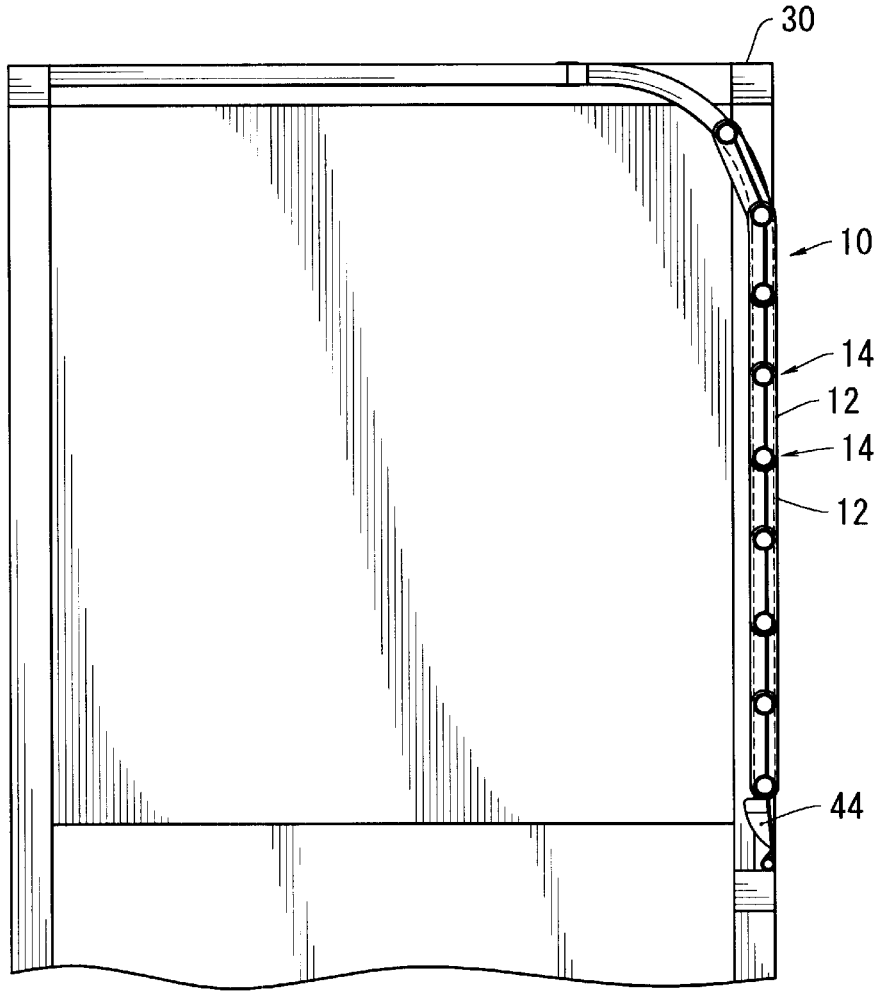
FIG. 2 is a detailed view of a shutter panel.

The embodiment as illustrated in FIGS. 1 and 2 relates to a shutter comprised of an shutter panel (10) for opening and closing an aperture formed to extend from a front surface to an upper surface of a housing (30) that serves as a processing room for machine tools and of a pair of guide rails (28) for holding the shutter plate (10) slidably.

The pair of guide rails (28) is mounted to a frame body (32), which is provided along the aperture of the housing (30), in a mutually opposite condition, and the shutter panel (10) that is to be further described later is held between the guide rails (28) in a freely sliding manner.

The shutter panel (10) is comprised of laterally elongated slats (12), hinge members (14) for connecting respective edges of longer sides of the slats (12) in a freely bendable manner, and inner link plates (13) and outer link plates (15) for connecting respectively adjoining hinge members (14). Each hinge member (14) is comprised of an outer tube **(16*a*) and an inner tube (16*b*) having C-shaped sections that are mounted along edges of longer sides of the slats (12)**.

Figure 3:
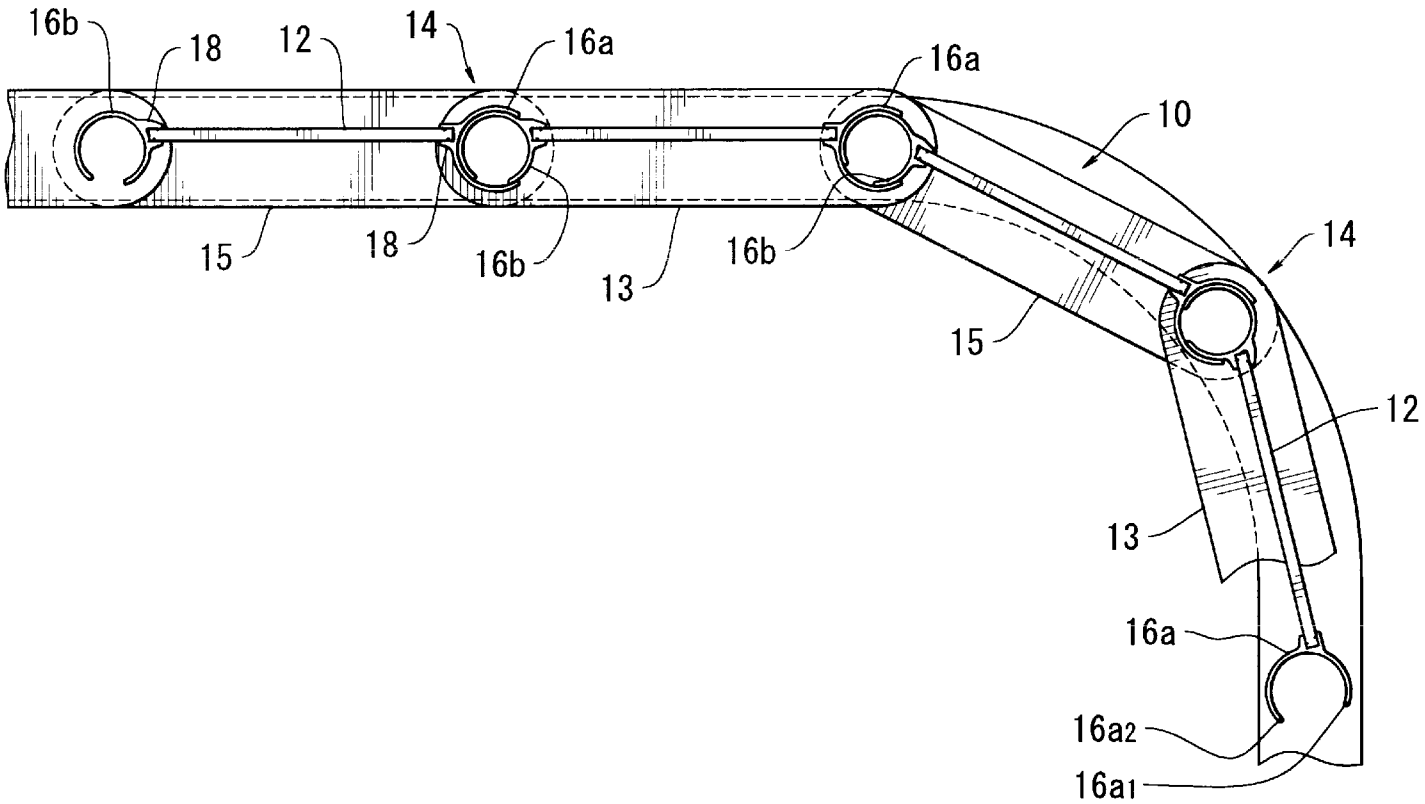
FIG. 3 is an exploded perspective view of hinge members.
Figure 4:
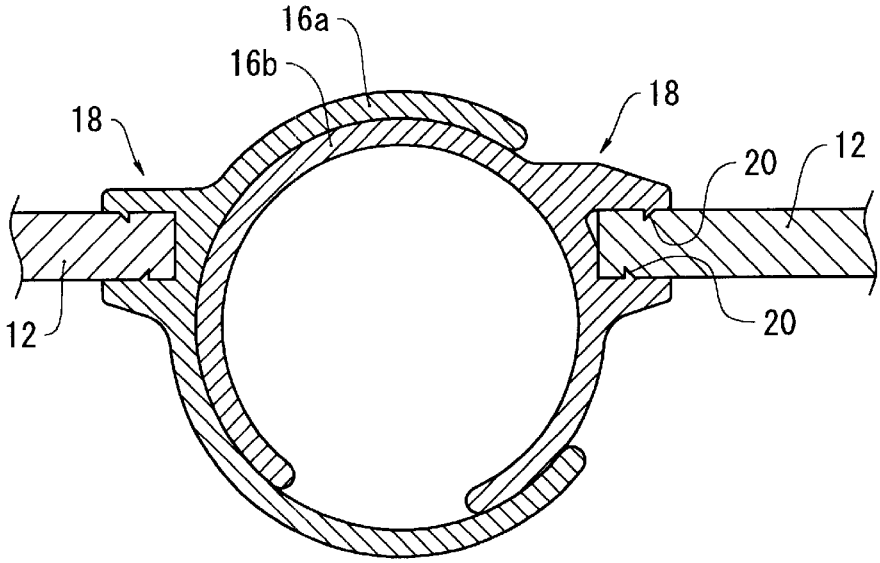
FIG. 4 is a detailed view illustrating a relationship between slats and the hinge members.

As illustrated in FIGS. 3 and 4, the outer tube **(16*a*) is arranged in that it is outwardly fitted to the inner tube (16*b*) rotatably, and the outer tube (16*a*) and the inner tube (16*b*) are respectively provided with holding portions (18) for inserting the edges of the slats (12)** therein and holding these thereby.

Each holding portion (18) mentioned above is comprised of a pair of holding pieces that are formed to project in a parallel manner along longer sides of the outer tube (16*a*) or the inner tube (16*b*), wherein opposing inner surfaces of the holding pieces are formed with engaging protrusions (20). Thus, by forcing the edge portions of the slats (12) having a specified thickness between the respective holding pieces, the edges of the slats (12) will be engaged and held by the engaging protrusions (20) to prevent slipping off therefrom.

Since a formed region of the holding portions (18) and opened region of the C-shaped section of the outer tube (16*a*) are respectively set to be of a specified range, the outer tube (16*a*) and the inner tube (16*b*) are respectively allowed to rotate around a certain angle. Accordingly, adjoining slats (12) are respectively connected by the hinge members (14) to be freely bendable within a range defined by the certain angle.

The outer tubes (16*a*) are further formed to project outward from both end of the slats (12) by a specified length such that projecting portions (160) of adjoining outer tubes (16*a*) will be respectively pierced into a pair of through holes formed on both end portions of the inner and outer link plates (13) and (15) so as to hold the inner and outer link plates (13) and (15) to be freely rotating along shorter sides of the slats (12). With this arrangement, the intervals between adjoining outer tubes (16*a*) will be maintained constantly by the inner and outer link plates (13) and (15) and prevented from separating.

Figure 5:
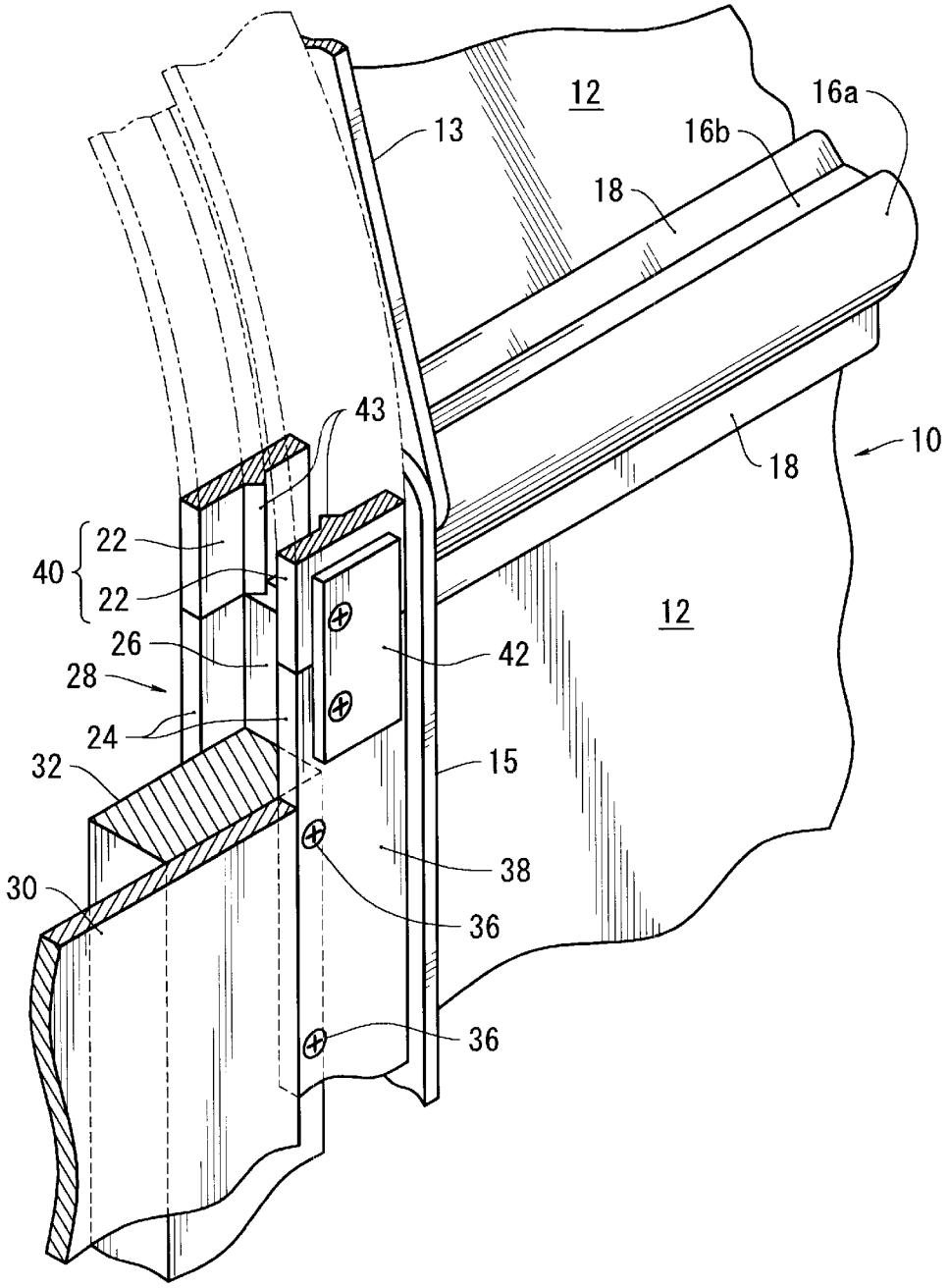
FIG. 5 is a partial perspective view of connecting portions of guide rails.
Figure 6:
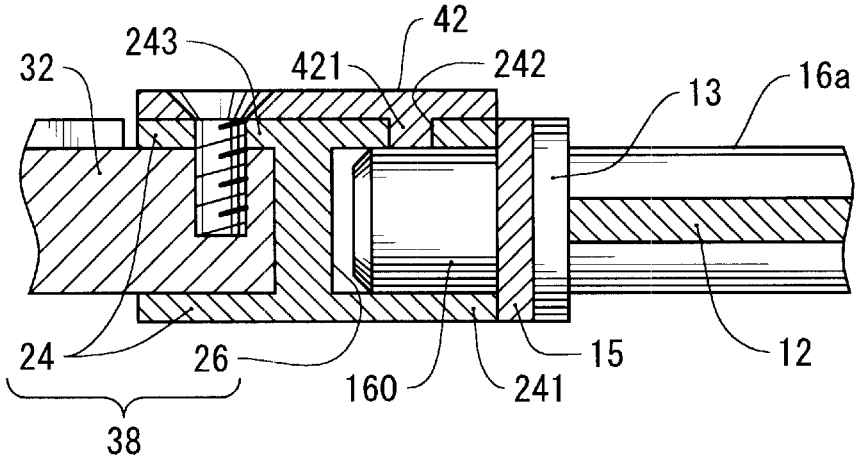
FIG. 6 is a partial sectional view of connecting portions and mounting portions of the guide rails.

As illustrated in FIGS. 5 and 6, the guide rails (28) are comprised of straight members (38) having a H-shaped section including a pair of parallel tie plates (24) and interval plates (26) for respectively connecting central portions of the tie plates (24), and of corner members (40) including a pair of parallel curved plates (22) formed to be concentric with the curved portions of the guide rails (28), and by connecting respective connecting end surfaces of the straight members (38) and the corner members (40) in an alternately abutting manner, it is possible to form the guide rails (28) with specified curved portions.

Ribs (43) which are similar to the interval plates (26) in width are formed to project from central portions of opposing inner surfaces of the pair of curved plates (22) so as to be succeeding to the interval plates (26) when abutted against the straight members (38).

As illustrated in FIG. 5, the tie plates (24) and curved plates (22) are connected by attaching plates (42) that are attached so as to cover with connecting portions thereof on outer peripheral surface sides when the tie plates (24) are abutted against the curved plates (22).

The attaching plates (42) are formed with positioning protrusions (421) in a projecting manner that are fitted into positioning holes (242) formed on inner half portions (241) between the respective tie plates (24), and are further formed with screw holes to screwing to the frame body (32) together with the outer half portions (243) between tie plates (24). The connecting portions between the tie plates (24) and the curved plates (22) on inner peripheral surface sides thereof may be connected in a similar manner.

As illustrated in FIG. 5, the guide rails (28) are fixed at their respective portions succeeding to the connecting portions between the straight members (38) and the corner members (40) provided by the attaching plates (42) to the aperture of the housing (30) such that the outer half portions (243) of the tie plates (24) and the outer portions of the curved plates (22) succeeding thereto are respectively fastened to the frame body (32) through screwing by mounting screws (36).

At this time, the intervals between the respective tie plates (24) of the straight members (38) and the intervals between the respective curved plates (22) of the corner members (40) are set to be intervals that suit the projecting portions (160) of the shutter panel (10) that is held thereby slidably.

In case the shutter panel (10) is attached to the guide rails (28) before mounting them to the frame body (32), the shutter may be mounted to the aperture to be freely openable or closable simultaneously with completing mounting of the guide rails (28)

The shutter according to the present example may be opened and closed by holding both end portions of the shutter panel (10), that is, the projecting portions (160) of the outer tubes (16*a*), into the inner half portions formed between the respective tie plates (24) and the respective curved plated portions (22).

At this time, the respective widths of groove portions along which the projecting portions (160) slide are preliminarily set to be suitable values at the time of forming the straight members (38) and the corner members (40), and since the width is maintained constant all over the guide rails (28)(28), sliding of the shutter panel (10) may be performed smoothly.

Since the corner members (40) of this example are particularly arranged in that a pair of curved plates (22), which are not connected with each other, are provided in a concentric manner, the intervals between the respective curved plates (22) can be set to be of appropriate values by respectively forming and setting the curvatures for the outer curved plate portion (22) and the inner curved portion (22) to be of specified values. Accordingly non-uniformities are hardly generated in the intervals between the respective curved plates (22) as it was likely to occur in the prior art when the curved portions were formed by bending a U-shaped member. It is further easier to set and maintain the intervals between the curved plates (22) when compared to a case in which they are formed to be of H-shaped section similar to the straight members (38).

By connecting the straight members (38) and the corner members (40) by using attaching plates (42), since the mounting screws (36) for fixing the guide rails (28) will be disposed at positions that are remote from the inner half portions body portions for holding the shutter panel (10), fixing members such as mounting screws (36) will not hinder sliding movements of the shutter panel (10).

Since a pair of ribs (43) succeeding from the tie plates (24) is formed so as to project from opposing inner surfaces of the pair of curved plates (22) and the end portions of projecting portions (160) of the outer tubes (16*a*) are supported by the ribs (43), they are not swung in lateral directions at the curved portions and not moved into the outer half portions. Therefore, there is no fear that the shutter panel (10) cannot be slide smoothly.

While the corner members (40) are comprised of a pair of curved plates (22) that are not connected with each other in this example, it is alternatively possible to ensure smoothness in sliding movements of the shutter panel (10) by employing corner members (40) with a H-shaped section similar to the straight members (38) in which respective curved plates (22) are connected by the interval plates (26) to assume a specified curvature.

The method for mounting the guide rails (28) to the frame body (32) may be a different method of mounting as long as the outer half portions (243) of the straight members (38) and the outer portions of the respective curved plates (22) of the corner members (40) succeeding thereto are utilized.

While the hinge members (14) may be formed of synthetic resin or metal, it is preferable that the slats (12) be formed of transparent or semi-transparent synthetic resin. In case the slats (12) are transparent, the interior of the housing (30) may be seen through from the slat portions (12) also when the shutter is closed.

Since the inner and outer link plates (13) and (15) are disposed at both end portions of the shutter panel (10), the slats (12) can be prevented from slipping off the holding portions (18) also when employing an arrangement in which the end edges of the slats (12) are fitted and engaged at the holding portions (18) of the outer tubes **(16*a*) and inner tubes (16*b*)**.

The invention is not limited to the above-described arrangement in which the straight members (38) and the corner members (40) are formed as separated members but the straight members (38) and the corner members (40) may also be integrally formed. It is also possible to integrally form the attaching plates (42) with the corner members (40).

In case the attaching plates (42) are integrally formed with the curved plates (24) of the corner members (40) through injection molding, easy assembly of the guide rails (28) is enabled since the attaching plates (42) are designed to align the outer peripheral side or the inner peripheral side of the outer surface of the straight members (38) in a positioned condition as described above when the corner members (40) are disposed in an abutted condition with respect to the straight members (38).

What is claimed is:

1. A shutter comprising a shutter panel and a pair of guide rails including curved portions, in which the shutter panel is composed of plural slats connected mutually in a freely bending condition and both end portions of the shutter panel are held by said guide rails slidably, characterized in that each of said guide rails includes straight members comprised of parallel tie plates and interval plates for connecting central portions of said tie plates mutually for having a H-shaped section, and corner members comprising curved plates respectively succeeding to said tie plates of said straight members, and said both end portions of said shutter panel are inserted between an inner half portions of said tie plates partitioned by said interval plates slidably, and outer half portions of said tie plates are mounted to a fixing portions.

2. The shutter according to claim 1, wherein said corner members are formed separately from said straight members, and said tie plates are connected to said curved plate in an abutted condition.

3. The shutter according to claim 1, wherein said corner members include said curved plate only, wherein said curved plates are abutted and connected to said tie plates by using attaching plates, and wherein said attaching plates are screwed on said outer half portions of said tie plates.

4. The shutter according to claim 2, wherein said corner members include said curved plate only, wherein said curved plates are abutted and connected to said tie plates by using attaching plates, and wherein said attaching plates are screwed on said outer half portions of said tie plates.

5. The shutter according to claim 3, wherein ribs are formed on outer peripheral surfaces of said curved plates located on inner side of said corner members and on inner peripheral surfaces of said curved plates located on outer side of said corner members so as to succeed to said interval plates.

6. The shutter according to claim 4, wherein ribs are formed on outer peripheral surfaces of said curved plates located on inner side of said corner members and on inner peripheral surfaces of said curved plates located on outer side of said corner members so as to succeed to said interval plates.

7. The shutter according to claim 3, wherein said attaching plates are integrally formed with said curved plates of said corner members.

8. The shutter according to claim 4, wherein said attaching plates are integrally formed with said curved plates of said corner members.

9. The shutter according to claim 5, wherein said attaching plates are integrally formed with said curved plates of said corner members.

10. The shutter according to claim 6, wherein said attaching plates are integrally formed with said curved plates of said corner members.

* * * * *